United States Patent [19]

Bates

[11] Patent Number: 4,742,995

[45] Date of Patent: May 10, 1988

[54] APPARATUS FOR INTRODUCING TREATMENT SUBSTANCES INTO LIQUIDS

[75] Inventor: Kenneth W. Bates, Chesterfield, Great Britain

[73] Assignee: Injectall Limited, Sheffield, England

[21] Appl. No.: 919,146

[22] PCT Filed: Feb. 12, 1986

[86] PCT No.: PCT/GB86/00073

§ 371 Date: Sep. 16, 1986

§ 102(e) Date: Sep. 16, 1986

[87] PCT Pub. No.: WO86/04928

PCT Pub. Date: Aug. 28, 1986

[30] Foreign Application Priority Data

Feb. 15, 1985 [GB] United Kingdom ..... 8503927

[51] Int. Cl.[4] ..... C21C 5/48

[52] U.S. Cl. ..... 266/270; 266/218

[58] Field of Search ..... 266/218, 265, 270

[56] References Cited

U.S. PATENT DOCUMENTS

| | | | |
|---|---|---|---|
| 2,698,749 | 1/1955 | Fishell | 266/207 |
| 2,855,293 | 10/1958 | Savard et al. | 266/218 |
| 3,137,753 | 6/1964 | Feichtinger | 266/207 |
| 3,971,548 | 7/1976 | Folgero et al. | 266/218 |
| 4,154,604 | 5/1979 | Gruner et al. | 75/53 |
| 4,295,883 | 10/1981 | Lajh | 75/68 R |
| 4,298,192 | 11/1981 | Barbakadze et al. | 266/218 |
| 4,575,393 | 3/1986 | Bates | 266/225 |

FOREIGN PATENT DOCUMENTS

| | | | |
|---|---|---|---|
| 91422 | 10/1983 | European Pat. Off. | 266/265 |
| 35369 | 10/1885 | Fed. Rep. of Germany | 266/265 |
| 2339 | 1/1953 | Fed. Rep. of Germany . | |
| 2004159 | 11/1971 | Fed. Rep. of Germany . | |
| 2503672 | 9/1975 | Fed. Rep. of Germany | 266/270 |
| 3115108 | 10/1982 | Fed. Rep. of Germany . | |
| 2633025 | 11/1982 | Fed. Rep. of Germany . | |
| 2444718 | 7/1980 | France . | |
| 808145 | 1/1959 | United Kingdom . | |
| 1083600 | 9/1967 | United Kingdom . | |
| 2041182 | 9/1980 | United Kingdom . | |
| 2094954 | 9/1982 | United Kingdom . | |
| 2140142 | 11/1984 | United Kingdom | 266/218 |
| 62579 | 8/1940 | U.S.S.R. . | |
| 289128 | 2/1971 | U.S.S.R. . | |
| 735640 | 5/1980 | U.S.S.R. . | |
| 741030 | 6/1980 | U.S.S.R. . | |
| 796242 | 5/1981 | U.S.S.R. . | |
| 891786 | 12/1981 | U.S.S.R. . | |

OTHER PUBLICATIONS

*Blocking in Horizontal Nozzles During Injection of Gas Into Liquid Cast Iron*, , K. G. Davis et al., Metals Technology, 1/79.

*Bubbling-Jetting Phenomena in Powder Injection into Liquid*, Y. Ozawa et al., Transactions ISIJ, vol. 23, 1983.

*Model Studies of Clogging in Tuyeres and Lances*, T. A. Engh et al., Scandinavian Journal of Metallurgy 5 (1975) 21-26.

*Use of Magnesium Wire Injection for the Desulphurization of Pig Iron*, M. C. Ashton et al., Ironmaking and Steelmaking (Quarterly), 1975, No. 2.

Patent Abstracts of Japan, vol. 9, No. 41, (C-267) (1764), Feb. 21, 1985 & JP, A, 59-185718 (Kawasaki), Oct. 22, 1984.

*Primary Examiner*—L. Dewayne Rutledge

*Assistant Examiner*—Robert L. McDowell

*Attorney, Agent, or Firm*—Frishauf, Holtz, Goodman & Woodward

[57] ABSTRACT

A cartridge-type injection device (20) is removably seated in a passage (18) through the wall of a ladle (10) and comprises a refractory nozzle tip (21) fitted to one end of a tubular body (30), and a delivery pipe (35) for gas or a mixture of gas and a particulate material, the pipe (35) entering an outer end of the body (30) and extending therethrough into the nozzle tip (21). An insulating packing is contained by the body around the pipe (35). The pipe is movable in the bore (22) of the tip (21) for dislodging a melt-obstructing plug in the bore (22) into the melt, whereupon the device is enabled to eject the gas or mixture from the pipe into the melt.

22 Claims, 2 Drawing Sheets

APPARATUS FOR INTRODUCING TREATMENT SUBSTANCES INTO LIQUIDS

TECHNICAL FIELD AND BACKGROUND

The present invention relates generally to the treatment of elevated temperature liquids by injection of gases or of gases accompanied by non-gaseous substances. More particularly, the invention concerns apparatus useful for injecting substances into molten non-ferrous or ferrous metals such as iron and steel while the metals are stationary in a vessel or flowing in a conduit. The invention is not limited to the treatment of liquids that are metals, however.

The liquids to be treated will be at such high temperatures that they may be regarded as aggressive or dangerous. The apparatus we have now developed has been designed to be safe in operation as well as adequately protected from the liquid up to the time treatment is to begin.

The apparatus to be described could also be used in winning or refining selected metals from their ores. For example, tungsten can be won by reduction in an arc furnace of the ore or an oxide thereof to the molten metallic state. The present apparatus can be employed to blow fresh powdered ore or oxide into the metallic melt of the furnace.

The apparatus disclosed hereinafter in detail can be employed when making steel from iron. It is suitable for use in vacuum degassing as a convenient means to introduce alloying additions. Primary and secondary refining, deoxidizing and desulphurizing can be performed to advantage with the aid of the apparatus. Compositions of steels (and other metals) can be controlled or modified by introducing gaseous and non-gaseous substances at any time before solidification. For instance, the melt can be treated in the furnace, in the ingot mould, as well as in vessels such as steelmaking vessels, ladles of various kinds, degassers and tundishes.

Before or during teeming in a metal casting operation, it may be necessary or desirable to introduce gas into the molten metal in a container or vessel. Gas is injected, e.g. into the bottom area of a vessel, for diverse purposes. These include rinsing; clearing the relatively cool bottom area of solidification products, to help remove them from the vicinity of a vessel bottom outlet from which the metal may be teemed; equalising the temperature throughout the melt; and stirring to help disperse alloying additions uniformly in the melt. Usually an inert gas such as argon is used. Reactive gases such as oxygen, carbon dioxide and hydrocarbon gases are sometimes substituted, depending on the melt chemistry.

Previous gas injection proposals have envisaged porous bricks in the refractory lining of a vessel, solid porous plugs in sliding gate teeming valves, and conventional consumable lances. Installations featuring porous bricks have the virtue of simplicity. Unfortunately, a porous brick exposed to the interior of the vessel may be rendered inoperative if metal slags or metal oxides freeze on it, e.g. between emptying the vessel and refilling it. Moreover, when refilling, these bricks could be damaged through impact of the molten metal thereon or through thermal shock. Unexpected failure of the brick can have extremely dangerous consequences. Visual inspection to detect the onset of failure is far from easy from a distance, looking down into the vessel.

Sliding gate valves adapted for gas injection may be safer, but unless overly complicated they are not able to offer the possibility of gas injection simultaneously with teeming.

Conventional lances are somewhat cumbersome, costly and not without their dangers in view of the splashing their use engenders.

Among other things, the present invention aims to overcome the above drawbacks associated with prior gas injection systems. The apparatus disclosed hereinafter is capable of introducing substances deep into a metal melt in a particularly cost-effective manner and provides benefits not so readily attainable by the consumable lances conventionally employed.

In ferrous metallurgy, the melt must often be deoxidised and desulphurised by introducing aluminum and calcium or its alloys. Composition control or "trimming" is commonly performed by dissolving powered alloying additions in the melt. Many materials can be added to melts to overcome the deleterious effects of impurities or to tailor the melts to produce specified compositions. We do not propose to provide an exhaustive catalogue of possible treatment materials. The choice of materials will depend on the melts, their starting and finishing compositions. It is well within the purview of the works chemist or metallurgist to choose appropriate addition(s) as each situation demands. Introducing additions to a steel melt—or indeed any other metal melt—can be troublesome especially if the alloying addition is readily melted, oxidised or vaporised. Thus, adding aluminium to a steel melt can be a difficult operation in view of the low melting point of aluminium. No significant deoxidation would be achieved if the aluminium were simply dumped onto the melt: it has to be delivered deep into the melt to react properly and should not float ineffectively on top of the melt. Calcium moieties also have to be fed deep into the melt. Previous delivery methods include use of a lance or sophisticated and expensive equipment for firing the alloying addition deep into the melt. Lancing is apparently simple but has drawbacks as intimated above.

DISCLOSURE OF THE INVENTION

The apparatus disclosed hereinafter facilitates the introduction of alloying or treatment additions e.g. in powder form deep into a metal melt. By means of this apparatus, precise dosing of the melt is a very straightforward operation. In its preferred form, inert or reactive gases can be blown into the melt in the course of introducing powders. The apparatus can be adapted straightforwardly to introduce alloying or treatment additions in wire or rod form.

According to one aspect of the present invention, there is provided an expendable injection device suitable for installing in a passage through a wall of a melt-containment vessel, for use to deliver gas or gas plus treatment substance e.g. in particulate form into a melt, the device comprising a main tubular body or sleeve, a refractory element received therein and pierced by a through passage, the refractory element projecting from an end of the body to define an extended nozzle, a dislodgeable closing means in the through passage at a discharge end of the nozzle, and a delivery pipe in the through passage in which the pipe is movable lengthwise, forcibly into contact with the closing means, to dislodge the closing means and enable the gas, or gas plus treatment substance, to exit from the pipe into the melt.

According to another aspect of the present invention, there is provided an injection device of cartridge form suitable for installing in a passage through a wall of a melt-containment vessel, for use to deliver gas or a mixture of gas and particulate matter into a melt, the device comprising a main tubular body fitted at one end with a refractory tip forming a nozzle, the nozzle projecting from the said end of the body and having a dislodgeable nozzle-closing means at its delivery end to prevent ingress of melt, a delivery pipe for the gas or mixture entering and extending through the body and into the bore of the nozzle, the pipe being movable lengthwise in the body and nozzle bore for dislodging the nozzle-closing means, and a packing of refractory material around the pipe inside the body.

The invention also provides apparatus for use to deliver gas or gas plus solid or particulate matter through the wall of a melt-containment vessel into melt contained therein, comprising the device as defined in either of the preceding paragraphs, means to connect a supply of said gas, or a supply of gas and said matter to the delivery pipe, and means to advance the pipe towards the discharge end of the nozzle to dislodge the said nozzle-closing means from the nozzle bore.

The pipe may have a closure at a discharge end thereof which is readily fusible or combustible upon exposure of the closure to the melt so that in use the pipe is suddenly opened to flow of gas, or gas plus said solid or particulate matter, into the melt.

The device will ordinarily be removed from the passage each time the vessel is emptied, for replacement in its entirely or for replacement of selected parts, e.g. the pipe. To aid removal the body, at its end remote from the nozzle, has means for engagement with a tool for installing and/or extracting the device from a passage therefor in the vessel wall.

For simplicity of use, the device is constructed as an expendable article.

BRIEF DESCRIPTION OF THE DRAWINGS

Aspects of this invention will now be described in more detail by way of example with reference to the accompanying drawings, in which.

MODES OF CARRYING OUT THE INVENTION

Figure 1:
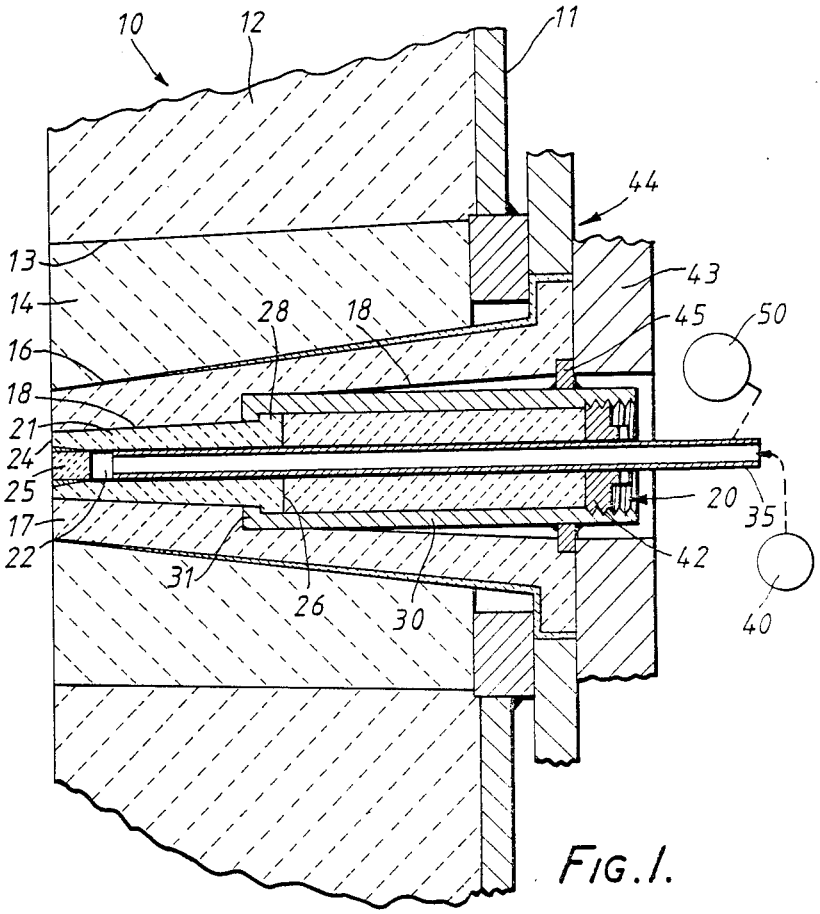
FIG. 1 is a longitudinal cross-section through a first embodiment of the invention, by means of which gases or gases and e.g. powders can be introduced into a metal melt.
Figure 2:
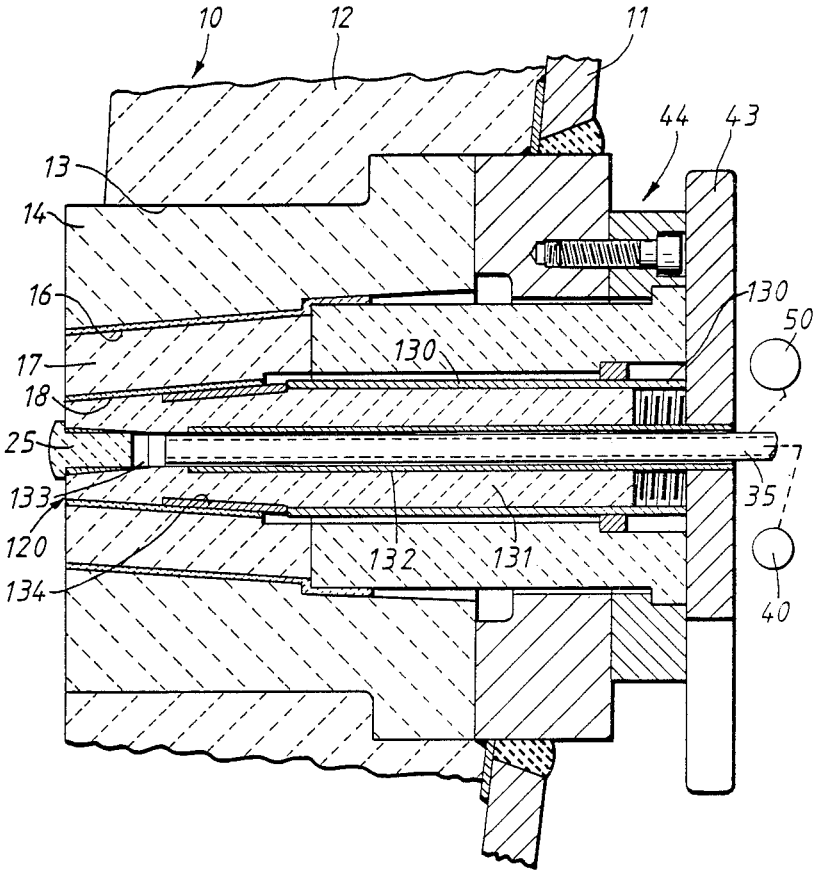
FIG. 2 is a similar view through a second embodiment of the invention.

In FIGS. 1 and 2, the same reference numerals are used for equivalent parts.

The accompanying drawings show apparatus according to the invention as installed in the wall of a vessel such as a ladle 10. Said apparatus could, however, be installed in the wall of a conduit along which the liquid to be treated is to flow.

As shown in FIG. 1, 11 is the metal shell of the ladle 10, and 12 is its refractory lining. The lining 12 has an opening 13 in which an apertured refractory block 14 is cemented. The block 14 has an inwardly-tapered passage 16 extending from one end to the other, and a correspondingly-shaped nozzle member 17 is located therein. The nozzle member 17 is cemented into the passage 16.

The nozzle member 17 itself has a central passage 18 extending therethrough from one end to the other. Passage 18 receives an injection device 20 according to this invention, by which means gas or a mixture of gas and powder is injected into the melt contained in the vessel or ladle 10.

The injection device 20 is an assembly of several components. At one end of the device 20 is a refractory nozzle tip 21 made either from a pressed and fired refractory such as aluminia or zirconia, or from a cast refractory concrete. The nozzle tip 21 has its central bore 22 plugged at a downstream end 24. Plug 25 in bore 22 is preferably a refractory material, e.g. fireclay, and can be held in the bore by a suitably weak cement. The cement guards against leakages and accidental or premature dislodgement of the plug 25. The cement bond should, nevertheless, allow the plug to be thrust without undue difficulty from the bore 22. The nozzle tip has an enlarged upstream end 26, the enlargement presenting a radially outwardly projecting circumferential rib or flange 28.

A second component of device 20 is a tubular sleeve or body member 30. The body member 30 has an inturned lip 31 at its inner or downstream end. The inside of body member 30 is large enough to pass the nozzle tip 21 and the lip 31 defines an opening through which all of the tip 21 can pass save for the flange 28. The nozzle tip and body are assembled such that the main part of the tip 21 projects outwardly beyond or away from the lipped inner end of the body 30; the flange 28 is located inside the body 30, seated against the inturned lip.

A third component of the device 20 is a metal feed pipe 35 for conveying gas, or gas plus treatment matter e.g. powder to the metal melt. The feed pipe is movable lengthwise of the device and is slidably received in the nozzle tip, the feed pipe extending outwardly beyond the wall 11 of the ladle, for connection to a supply or supplies 40 of gas, solid or particulate matter for introduction to the melt. This embodiment is primarily meant for injecting a gas and powder mixture to the melt.

The pipe 35 extends from the central bore of the nozzle tip 21, axially through the body member 30. The pipe passes through a central opening in a closure 42 secured e.g. by a screw thread to the upstream or outer end of the body member 30.

The space around the pipe 35 inside the body member 30 is filled with a refractory liner tube or other refractory material.

The passage 18 in nozzle member 17 is counterbored or otherwise profiled longitudinally to mate suitably with the device 20, so that melt is unable to leak from the ladle 10 along the passage 18. Leak-tightness can be assured by the use of a weak refractory cement or mastic between confronting surfaces of the passage 18 and device 20.

The device is detachably held in the passage 18 by a clamp plate 43 and associated mounting structure 44, the structural details of which do not form a part of the present invention. The clamping means as shown coact with an abutment flange 45 on the body member 30 to thrust the flange 45 firmly into a rebate therefor in the outer end of the nozzle member 17. The clamping means also thrust the nozzle member 17 into its operationally-seated position in the passage 16 of the refractory block 14.

In use, the device 20 is set up as shown in the drawing, i.e. with the discharge end of the pipe 35 withdrawn rearwardly or upstream from the plug 25 in the nozzle tip. The pipe is suitably connected to the supply 40 of gas or gas plus powder. The pipe is also operatively connected to an actuating means 50. The actuating means is for advancing the pipe 35 lengthwise towards the end of the nozzle tip 21. The pipe actuating means 50 can be a cam and lever device or any other convenient arrangement, and its exact implementation does not form a part of this invention.

At a suitable time after filling the ladle with the melt, the actuating means 50 is operated. The pipe 35 is advanced along the bore 22 of the nozzle tip 21. The discharge end of pipe 35 engages the plug 25 and thrusts the latter from the nozzle tip 21 into the melt, so that gas, or gas and powder, are thus suddenly released into the melt.

When treatment of the melt using the device 20 is concluded, supply of gas to the pipe 35 is terminated. Melt then flows into the pipe 35. After flowing a short distance along the pipe (e.g. 2 inches—5 cm—or so) the melt will reach a cool enough region wherein it freezes, thus blocking the pipe 35 against dangerous out-flow of the melt. The freezing melt may weld to the pipe. Ordinarily, the frozen melt will be located inside the nozzle tip 21.

Subsequently, the ladle is tapped and, before refilling, either the device 20 is replaced in entirety, or at least its blocked pipe is withdrawn and discarded, and a fresh pipe 35 and plug 25 are installed. The device 20 can be extracted from the nozzle member 17 by attaching a suitable threaded extractor tool to the body 30 after first releasing the clamping plate 43. Provided the pipe does not weld or otherwise jam immovably in the nozzle tip 21, it may be pulled or driven from the device 20.

Periodically, the nozzle member 17 may need replacing as it becomes eroded or chemically attacked by the melt. For economy, it may be preferred for the nozzle member to be cast from a refractory concrete.

In the embodiment illustrated in FIG. 1, the sleeve or body member is a metal e.g. steel fabrication, as is threaded closure 42.

If the frozen melt welds to tube 35 and also adheres to the nozzle tip 21, the need for a special extraction tool and for a mating configuration in the device 20 could be avoided. The outer end of the tube 35 could then be grasped and pulled outwardly to extract the device 20 from the passage 18. Alternatively, the discharge end of the bore 22 of the nozzle tip 21 could be enlarged so that when the melt freezes and welds to the pipe, a lump of frozen metal forms which cannot be pulled rearwardly through the bore 22. The device 20 can then be extracted from the passage 18 by pulling on the pipe 35.

Pipe 35 could be made from a refractory material, metal e.g. mild steel, but preferably is a refractory-lined metal pipe.

To guard against the nozzle tip 21 possibly being damaged before or during installation of the device 20, the tip could have an external reinforcing metal sheath. The sheath can extend part-way along the tip 21, terminating short of the discharge end thereof.

It will be appreciated that the cartridge-type injection device 20 offers the metal producer the benefit of great convenience, especially when the device 20 is in an inexpensive, expendable form.

Figure 1A:
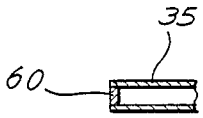
FIG. 1A shows a detail of the end portion of page 35.

Another embodiment of the invention is largely similar, and is shown in FIG. 2. The device 120 has a body member 130 comprising a metal e.g. steel tube or sleeve internally screw-threaded at one end for an extraction tool to be engaged therewith. Inside the body member there is a refractory liner 131 e.g. made of a castable concrete. The liner projects from one, inner end of the body member 130 and is pierced from end to end by a through passage. A metal tube 132 lines a major part of the length of the through passage 133. The portion of liner 131 extending beyond the end of body member 130 is tapered, partly encased in a metal jacket 134, and constitutes a nozzle 121. Thus, unlike the first embodiment, here the nozzle 121 and liner 131 are integral with one another. Nozzle 121 is weakly but leak-tightly secured in the passage 16 of member 17 by frangible cement or refractory mastic. A dislodgeable closing means or plug 25 is fitted at the discharge end of the nozzle 121 in passage 133. Delivery pipe 35 is received in the through passage 133 and is free to move axially therein. The pipe 35 is coupled, as before, to supply means 40 and actuating means 50. At its downstream end, the pipe 35 is optionally closed by a temporary closure 60 (see FIG. 1A) which may be fusible or combustible.

Using this embodiment, injection of gas, gas plus powder or gas plus wire proceeds in essence, the same as before. After use, the device 120 can be extracted in the same way as device 20.

The device 120 can be readily made by an in-situ casting technique, using the body member 130, the jacket 134 and the metal tube 132 as moulding members.

The constructions employed for both embodiments lend themselves to the production of inexpensive, expensable injection devices.

INDUSTRIAL APPLICABILITY

The invention is applicable to the treatment of high temperature liquids such as molten metals, wherein the treatment involves injecting gas, or gas plus powder or gas plus wire via the inventive device through the wall of a vessel containing the liquid, deep below the surface of the liquid. By this means, treatment of the liquid, e.g. to change its composition, using reactive or volatile substances is made most efficient.

I claim:

1. An expendable injection cartridge device suitable for installing in a passage through a wall of a melt-containment vessel, for use to deliver injectant into a melt, the device comprising:

an upstream part including a main tubular body or sleeve;

a downstream part including a refractory element fixedly secured inside the main tubular body and projecting from a downstream end thereof, said refractory element being pierced by a through passage to thereby define an extended nozzle, a melt-impervious, passaage-blocking closure dismountably affixed at a discharge end of the nozzle; and an injectant delivery pipe which extends through said body and into said passage, said delivery pipe being movable lengthwise of said device forcibly into contact with said closure for dismounting same from the nozzle element to enable injectant fed into said delivery pipe to exit therefrom and discharge into the melt.

2. A device according to claim 1, wherein said main tubular body has a closure at an end thereof remote from the nozzle to retain refractory material in said main tubular body, the closure having a pipe-guiding aperture aligned with the nozzle bore.

3. A device according to claim 2, wherein said nozzle has a nozzle tip with a flanged end, and wherein said main tubular body comprises a metal tube having an inturned lip at said one end thereof to provide a seating for said flanged and of said nozzle tip.

4. A device according to claim 1, wherein said nozzle has a nozzle tip with a flanged end, and wherein said main tubular body comprises a metal tube having an inturned lip at said one end thereof to provide a seating for said flanged end of said nozzle tip.

5. A device according to claim 1 wherein said delivery pipe has an end closure at a discharge end thereof which is readily fusible or combustible upon exposure of said end closure to the melt so that in use, said delivery pipe is suddenly opened to flow of gas, or said mixture, into the melt.

6. A device according to claim 1, wherein said main tubular body, at its end remote from the nozzle, comprises engagement means for engagement with a tool for installing and/or extracting the injection device from a passage therefor in the wall of the melt-containment vessel.

7. A device according to claim 5, wherein said engagement means comprises a screw-threaded formation at said remote end of said main tubular body.

8. A device according to claim 1, wherein said delivery pipe is a steel tube.

9. A device according to claim 1, further comprising in combination a refractory body for installation of said injection device in said vessel wall, said refractory body having a passage therethrough for receiving said injection device leaktightly and removably.

10. A device according to claim 1, further comprising:

means for connecting a supply of said injectant to said delivery pipe; and means for advancing said delivery pipe toward the discharge end of the nozzle to dislodge said passage-blocking closure from the nozzle.

11. An injection device of cartridge form suitable for installing in a passage through a wall of a melt-containment vessel, for use to deliver injectant into a melt, the device comprising;

a main tubular body;

a refractory tip forming a nozzle secured to and inset in a downstream end of said main tubular body and projecting downstream away from the said downstream end;

a melt-impervious, nozzle-blocking closure dismountably affixed at a delivery end of said nozzle to prevent ingress of melt;

an injectant delivery pipe entering and extending through the main tubular body and into the bore of the nozzle, said delivery pipe being movable lengthwise in the main tubular body and nozzle bore for forcibly engaging the nozzle-blocking closure for dismounting same to enable injectant fed into said delivery pipe to discharge into the melt; and an insulating packing of refractory material inside the main tubular body surrounding said delivery pipe.

12. A device according to claim 11, wherein said main tubular body has a closure at an end thereof remote from the nozzle to retain refractory material in said main tubular body, the closure having a pipe-guiding aperture aligned with the nozzle bore.

13. A device according to claim 12, wherein said nozzle has a nozzle tip with a flanged end, and wherein said main tubular body comprises a metal tube having an inturned lip at said one end thereof to provide a seating for said flanged end of said nozzle tip.

14. A device according to claim 11, wherein said nozzle has a nozzle tip with a flanged end, and wherein said main tubular body comprises a metal tube having an inturned lip at said one end thereof to provide a seating for said flanged end of said nozzle tip.

15. A device according to claim 11 wherein said delivery pipe has an end closure at a discharge end thereof which is readily fusible or combustible upon exposure of said end closure to the melt so that in use, said delivery pipe is suddenly opened to flow of gas, or said mixture, into the melt.

16. A device according to claim 11, wherein said main tubular body, at its end remote from the nozzle, comprises engagement means for engagement with a tool for installing and/or extracting the injection device from a passage therefor in the wall of the melt-containment vessel.

17. A device according to claim 16, wherein said engagement means comprises a screw-threaded formation at said remote end of said main tubular body.

18. A device according to claim 11, wherein said delivery pipe is a steel tube.

19. A device according to claim 11, further comprising in combination a refractory body for installation of said injection device in said vessel wall, said refractory body having a passage therethrough for receiving said injection device leaktightly and removably.

20. A device according to claim 11, further comprising:

means for connecting a supply of said injectant to said delivery pipe; and means for advancing said delivery pipe toward the discharge end of the nozzle to dislodge said nozzle-blocking closure from the nozzle.

21. An injection cartridge device suitable for installing in a passage through a wall of a melt-containment vessel, for use to deliver injectant into a melt, the device comprising;

a main tubular body fitted at one end with a refractory tip forming a nozzle having a bore therein, the nozzle projecting from said one end of said main tubular body and having a dislodgeable nozzle-closing means at a delivery end thereof to prevent ingress of melt;

a delivery pipe for said injectant, said delivery pipe entering and extending through said main tubular body and into the bore of the nozzle, the delivery pipe being movable lengthwise in said main tubular body and nozzle bore for dislodging said nozzle-closing means;

a packing of refractory material around said delivery pipe inside said main tubular body;

said nozzle having a nozzle tip with a flanged end; and said main tubular body comprising a metal tube having an inturned lip at said one end thereof to provide a seating for said flanged end of said nozzle tip.

22. A device according to claim 21, wherein said main tubular body has a closure at an end thereof remote from the nozzle to retain refractory material in said main tubular body, the closure having a pipe-guiding aperture aligned with the nozzle bore.

* * * * *